US008448573B1

(12) United States Patent
Dutton et al.

(10) Patent No.: US 8,448,573 B1
(45) Date of Patent: May 28, 2013

(54) METHOD OF FUZING MULTIPLE WARHEADS

(75) Inventors: Brian Dwayne Dutton, Ridgecrest, CA (US); John Kevin Kandell, Ridgecrest, CA (US); Gabriel Henry Soto, Ridgecrest, CA (US)

(73) Assignee: The United States of America as Represented by the Secretary of the Navy, Washington, DC (US)

( * ) Notice: Subject to any disclaimer, the term of this patent is extended or adjusted under 35 U.S.C. 154(b) by 324 days.

(21) Appl. No.: 12/889,135

(22) Filed: Sep. 23, 2010

Related U.S. Application Data

(60) Provisional application No. 61/326,977, filed on Apr. 22, 2010.

(51) Int. Cl.
*F23Q 7/02* (2006.01)

(52) U.S. Cl.
USPC ..... 102/206; 102/215; 102/217; 102/276

(58) Field of Classification Search
USPC ..... 102/206, 215, 217, 221, 275.9, 275.11, 102/276
See application file for complete search history.

(56) References Cited

U.S. PATENT DOCUMENTS

| | | | | | |
|---|---|---|---|---|---|
| 2,940,392 | A * | 6/1960 | Loren et al. | ..... | 102/206 |
| 3,385,214 | A * | 5/1968 | Decker | ..... | 102/206 |
| 4,334,475 | A * | 6/1982 | Turchi | ..... | 102/206 |
| 4,580,498 | A * | 4/1986 | Abt et al. | ..... | 102/215 |
| 4,825,766 | A * | 5/1989 | Ruthen | ..... | 102/215 |
| 5,012,742 | A * | 5/1991 | Jones | ..... | 102/418 |
| 5,119,715 | A * | 6/1992 | Porter et al. | ..... | 89/6.5 |
| 5,131,328 | A * | 7/1992 | Chan | ..... | 102/229 |
| 5,282,421 | A * | 2/1994 | Marsh et al. | ..... | 102/217 |
| 5,460,093 | A * | 10/1995 | Prinz et al. | ..... | 102/217 |
| 5,585,592 | A * | 12/1996 | Stearns et al. | ..... | 102/233 |
| 5,587,550 | A * | 12/1996 | Willis et al. | ..... | 102/217 |
| 5,621,184 | A * | 4/1997 | Gwynn, III | ..... | 102/215 |
| 5,886,284 | A * | 3/1999 | Will et al. | ..... | 102/206 |
| 6,109,185 | A * | 8/2000 | Mikhail | ..... | 102/476 |
| 6,138,571 | A * | 10/2000 | Denney | ..... | 102/206 |
| 6,295,932 | B1 * | 10/2001 | Kane, III | ..... | 102/221 |
| 6,584,907 | B2 * | 7/2003 | Boucher et al. | ..... | 102/217 |
| 6,629,498 | B1 * | 10/2003 | Marquis | ..... | 102/215 |
| 6,634,298 | B1 * | 10/2003 | Denney | ..... | 102/206 |
| 6,889,610 | B2 * | 5/2005 | Boucher et al. | ..... | 102/217 |
| 7,124,689 | B2 * | 10/2006 | Davis et al. | ..... | 102/216 |
| 7,278,658 | B2 * | 10/2007 | Boucher et al. | ..... | 280/741 |
| 7,591,225 | B1 * | 9/2009 | Cope et al. | ..... | 102/221 |
| 7,748,324 | B2 * | 7/2010 | Sutcliffe | ..... | 102/265 |
| 2004/0088112 | A1 * | 5/2004 | Dirks et al. | ..... | 701/213 |
| 2005/0056723 | A1 * | 3/2005 | Clancy et al. | ..... | 244/3.24 |

(Continued)

*Primary Examiner* — Michael Carone
*Assistant Examiner* — Derrick Morgan
(74) *Attorney, Agent, or Firm* — Christopher L. Blackburn

(57) ABSTRACT

A multiple warhead fuzing apparatus including a first warhead and a second warhead. Operation/detonation of the first and second warheads is controlled using safe and arming logic and an onboard weapon computer that communicates triggering and fire signal parameters to fire signal logic located on the weapon. For a hard target application, the initiation module(s) of each warhead will initiate when commanded by the warhead's fuze after specific criteria has been satisfied, as determined by the fuze programming from the weapon computer. Soft target applications will require the warheads to initiate simultaneously after a delay from impact. The large area target settings will initiate all warheads upon receipt of a fire command from the weapon computer or height of burst sensor.

4 Claims, 1 Drawing Sheet

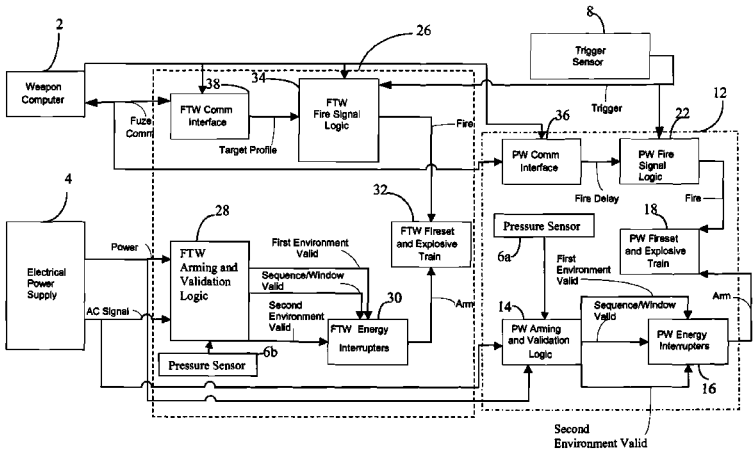

U.S. PATENT DOCUMENTS

2006/0090663 A1* 5/2006 Biggs et al. ..... 102/215
2006/0107862 A1* 5/2006 Davis et al. ..... 102/216
2008/0121131 A1* 5/2008 Pikus et al. ..... 102/215
2011/0056399 A1* 3/2011 Yan et al. ..... 102/215
2011/0277620 A1* 11/2011 Havran et al. ..... 89/1.14
2012/0012019 A1* 1/2012 Harding et al. ..... 102/206

* cited by examiner

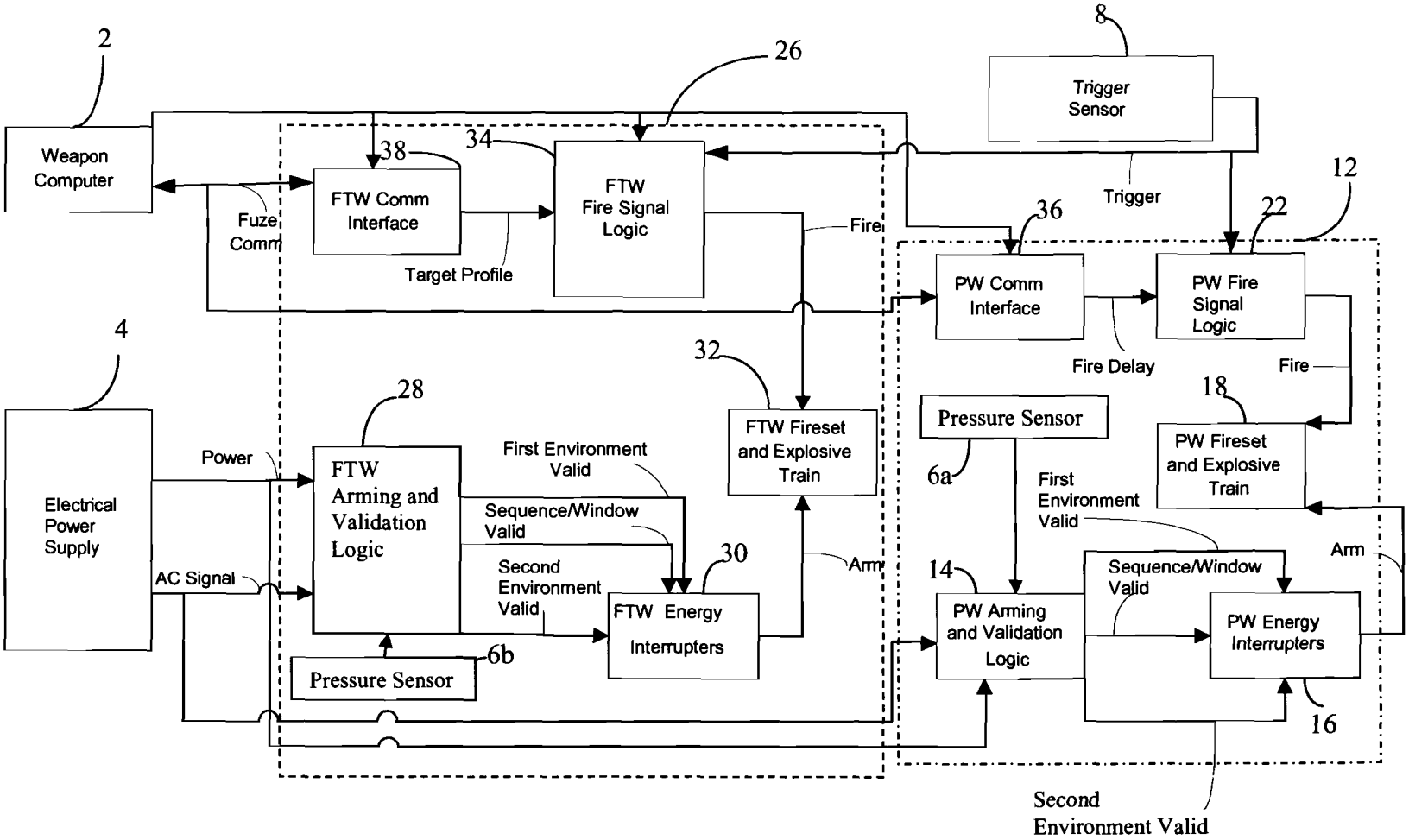
Trigger Sensor
8
Trigger
12
22
PW Fire Signal Logic
Fire
PW Fireset and Explosive Train
18
Arm
PW Energy Interrupters
16
Sequence/Window Valid
Second Environment Valid
Fire Delay
36
PW Comm Interface
Pressure Sensor
6a
First Environment Valid
PW Arming and Validation Logic
14
26
FTW Fire Signal Logic
34
Fire
FTW Fireset and Explosive Train
32
Arm
FTW Energy Interrupters
30
First Environment Valid
Sequence/Window Valid
Second Environment Valid
Target Profile
38
FTW Comm Interface
28
FTW Arming and Validation Logic
6b
Pressure Sensor
Fuze Comm
Power
AC Signal
2
Weapon Computer
4
Electrical Power Supply

METHOD OF FUZING MULTIPLE WARHEADS

CROSS-REFERENCE TO RELATED APPLICATIONS

This application claims benefit of, and priority to, U.S. Provisional Patent application having application No. 61,326,977 filed Apr. 22, 2010 under 35 U.S.C. 119(e).

STATEMENT REGARDING FEDERALLY SPONSORED RESEARCH OR DEVELOPMENT

The invention described herein may be manufactured and used by or for the government of the United States of America for governmental purposes without the payment of any royalties thereon or therefor.

FIELD OF THE INVENTION

The invention relates to a method of fuzing multiple warheads.

BRIEF DESCRIPTION OF THE DRAWING

FIG. 1 illustrates a block diagram of an embodiment of the invention.

It is to be understood that the foregoing general description and the following detailed description are exemplary and explanatory only and are not to be viewed as being restrictive of the invention, as claimed. Further advantages of this invention will be apparent after a review of the following detailed description of the disclosed embodiments, which are illustrated schematically in the accompanying drawings and in the appended claim.

DETAILED DESCRIPTION

With reference to FIG. 1, apparatus embodiments include a weapon computer 2 located within a weapon. An electrical power supply 4 is located within the weapon. At least one pressure sensor 6*a*, 6*b* is located within the weapon. In some embodiments, a first pressure sensor 6*a* is associated with a pre-cursor warhead ('PW') arming and validation logic 14 and is located within a pre-cursor warhead fuze module 12. In other embodiments, the first pressure sensor 6*a* is associated with the pre-cursor warhead arming and validation logic 14 and is associated with the weapon but is not located within the pre-cursor warhead fuze module 12. In some embodiments, a second pressure sensor 6*b* is associated with a follow through warhead ('FTW') arming and validation logic 28 and is located within a follow through warhead fuze module 26. In other embodiments, the second pressure sensor 6*b* is associated with the follow through warhead arming and validation logic 28 and is associated with the weapon but is not located within the follow through warhead fuze module 26.

At least one trigger sensor 8 is located with the weapon. The trigger sensor 8 can be a height of burst sensor or an impact sensor. Where a height of burst sensor is included, the height of burst sensor is selected from the group of sensors consisting of infrared (IR) laser and radio frequency (RF) proximity fuze. The impact sensor is selected from the group of sensors consisting of: accelerometer, g-switch, and crush switch.

Embodiments also include at least one pre-cursor warhead located with the weapon. A pre-cursor warhead fuze module 12 is located within the weapon and electrically associated with the electrical power supply 4, pre-cursor warhead, and the at least one trigger sensor 8. The pre-cursor warhead fuze module 12 includes pre-cursor warhead arming and validation logic 14 for arming the pre-cursor warhead. The pre-cursor warhead arming and validation logic is electrically associated with the electrical power supply 4 and a pre-cursor warhead energy interrupter 16.

The pre-cursor warhead energy interrupter 16 is electrically associated with a pre-cursor warhead fireset and explosive train 18. The pre-cursor warhead fireset and explosive train 18 includes a pre-cursor warhead firing capacitor for storing arming energy and a trigger switch for dumping energy onto a pre-cursor warhead warhead initiator when the pre-cursor warhead is armed and a firing signal is communicated to the pre-cursor warhead fireset and explosive train 18 from the pre-cursor warhead fire signal logic 22. The pre-cursor warhead energy interrupters 16 interrupts power transfer between the electrical power supply 4 and the pre-cursor warhead fireset and explosive train 18 preventing arming of the pre-cursor warhead until the pre-cursor warhead energy interrupter 16 receives a plurality of pre-determined pre-cursor warhead arming signals communicated from the pre-cursor warhead arming and validation logic 14 indicating that a first environment is valid, a second environment is valid, that the first environment was valid prior to the second environment becoming valid, and that the first and second environment were determined to be valid within a pre-determined temporal window.

The pre-cursor warhead arming and validation logic 14 and the pre-cursor warhead energy interrupter 16 are adapted and associated to arm at least one of the at least pre-cursor warhead by allowing electrical power to flow from the electrical power supply to the pre-cursor warhead fireset and explosive train 18 when the pre-cursor warhead energy interrupter 16 receives a plurality of pre-determined arming signals communicated from the pre-cursor warhead arming and validation logic 14 indicating that the first environment is valid, the second environment is valid, that the first environment was valid prior to the second environment becoming valid, and that the first and second environment were determined to be valid within a pre-determined temporal window. Pre-cursor warhead arming and validation logic 14 further includes a first means for determining whether the weapon has experienced a transition from no differential pressure to a pre-determined differential pressure (and that the transition to a pre-determined differential pressure is maintained for at least a pre-determined amount of time) and a first means for determining whether power supplied to the pre-cursor warhead arming and validation logic 14 is within a predetermined range of frequency and amplitude. The first means for determining whether the weapon has experienced a transition from no differential pressure to a pre-determined differential pressure (and that the transition to a pre-determined differential pressure is maintained for at least a pre-determined amount of time) is selected from the group of technologies adapted to determine whether the weapon has experienced a transition from no differential pressure to a pre-determined differential pressure (and that the transition to a pre-determined differential pressure is maintained for at least a pre-determined amount of time) consisting of an FPGA; discrete circuitry; and an integrated circuit. The first means for determining whether power supplied to the pre-cursor warhead arming and validation logic 14 is within a predetermined range of frequency and amplitude is a different technology than the technology of the first means for determining whether the weapon has experienced a transition from no differential pressure to a pre-determined differential pressure and is selected from the group of technologies adapted to determine whether power supplied to the pre-cursor warhead arming and validation logic 14 is within a predetermined range of frequency and amplitude consisting of an FPGA; discrete circuitry; and an integrated circuit. The pre-cursor warhead energy interrupter 16 includes a series of switches (electrical and/or mechanical). The switches (electrical and/or mechanical) are adapted to allow power to flow from the pre-cursor warhead arming and validation logic 14 to the pre-cursor warhead fireset and explosive train 18 only when a plurality of pre-determined pre-cursor warhead arming signals indicating that a first environment is valid, a second environment is valid, that the first environment was valid prior to the second environment becoming valid, and that the first and second environment were determined to be valid within a pre-determined temporal window is communicated from the pre-cursor warhead arming and validation logic 14 to the pre-cursor warhead series of switches (electrical and/or mechanical). In some embodiments, the switches are metal-oxide-semiconductor field-effect transistor (MOSFET).

The pre-cursor warhead fuze module 12 also includes pre-cursor warhead fire signal logic 22 electrically associated with the weapon computer 2 and pre-cursor warhead fireset and explosive train 18. The pre-cursor warhead fire signal logic 22 is adapted to start a pre-cursor warhead back-up timer when at least one trigger sensor 8 is triggered. In some embodiments, the trigger sensor 8 is triggered when the weapon has reached a pre-determined height above a predetermined object. In other embodiments, the trigger sensor 8 is triggered when the weapon experiences an impact with a pre-determined object. The pre-cursor warhead fire signal logic 22 is adapted to communicate a fire signal to the pre-cursor warhead fireset and explosive train 18 upon each of the following occurrences until the pre-cursor warhead explodes: 1) at least one pre-cursor warhead trigger is received; 2) the pre-cursor warhead back-up timer has expired. A pre-cursor warhead fuze communication interface 36 for communication between the weapon computer 2 and the pre-cursor warhead fire signal logic 22, the weapon computer 2 being programmed to communicate to the pre-cursor warhead fire signal logic 22 the parameters of the at least one trigger and the length of time of the pre-cursor warhead back-up timer.

Embodiments also include at least one follow through warhead located with the weapon. A follow through warhead fuze module 26 is located within the weapon and electrically associated with the electric power supply, the follow through warhead, and the at least one trigger sensor 8. The follow through warhead fuze module 26 includes follow through warhead arming and validation logic 28 electrically associated with the electrical power supply and a follow through warhead energy interrupter 30. The follow through warhead energy interrupter 30 is electrically associated with a follow through warhead fireset and explosive train 32. The follow through warhead fireset and explosive train 32 includes a follow through warhead firing capacitor for storing arming energy and a trigger switch for dumping energy onto a follow through warhead warhead initiator when the follow through warhead is armed and a firing signal is communicated to the follow through warhead fireset and explosive train 32 from the follow through warhead fire signal logic 34. The follow through warhead energy interrupter 30 interrupts power transfer between the electrical power supply and the follow through warhead fireset and explosive train 32 preventing arming of the follow through warhead until the follow through warhead energy interrupter 30 receives a plurality of pre-determined signals communicated from the follow through warhead arming and validation logic 28 indicating that a first environment is valid, a second environment is valid, that the first environment was valid prior to the second environment becoming valid, and that the first and second environment were determined to be valid within a pre-determined temporal window. The follow through warhead arming and validation logic 28 and follow through warhead energy interrupter 30 are adapted and associated to arm at least one of the at least one follow through warhead by allowing electrical power to flow from the electrical power supply to the follow through warhead fireset and explosive train 32 when the follow through warhead energy interrupter 30 receives a plurality of pre-determined signals communicated from the follow through warhead arming and validation logic 28 indicating that a first environment is valid, a second environment is valid, that the first environment was valid prior to the second environment becoming valid, and that the first and second environment were determined to be valid within a pre-determined temporal window. The follow through warhead arming and validation logic 28 includes a second means for determining whether the weapon has experienced a transition from no differential pressure to a pre-determined differential pressure (and that the transition to a pre-determined differential pressure is maintained for at least a pre-determined amount of time) and a second means for determining whether power supplied to the follow through warhead arming and validation logic 28 is within a predetermined range of frequency and amplitude. The second means for determining whether the weapon has experienced a transition from no differential pressure to a pre-determined differential pressure (and that the transition to a pre-determined differential pressure is maintained for at least a pre-determined amount of time) is selected from the group of means consisting of: an FPGA electrically associated with the at least one pressure sensor, the FPGA being configured and programmed to determine whether the weapon has experienced a transition from no differential pressure to a pre-determined differential pressure; discrete circuitry adapted to determine whether the weapon has experienced a transition from no differential pressure to a pre-determined differential pressure; and an integrated circuit configured and programmed to determine whether the weapon has experienced a transition from no differential pressure to a pre-determined differential pressure. The second means for determining whether power supplied to the follow through warhead arming and validation logic 28 is within a predetermined range of frequency and amplitude is a different technology than the technology of the second means for determining whether the weapon has experienced a transition from no differential pressure to a pre-determined differential pressure and is selected from the group of technologies adapted to determine whether power supplied to the follow through warhead arming and validation logic 28 is within a predetermined range of frequency and amplitude consisting of: an FPGA; discrete circuitry; and an integrated circuit.

The follow through warhead energy interrupter 30 includes a series of switches (electrical and/or mechanical). The switches (electrical and/or mechanical) are adapted to allow power to flow from the follow through warhead arming and validation logic 28 to the follow through warhead fireset and explosive train 32 only when a plurality of pre-determined follow through warhead arming signals indicating that a first environment is valid, a second environment is valid, that the first environment was valid prior to the second environment becoming valid, and that the first and second environment were determined to be valid within a pre-determined temporal window is communicated from the follow through warhead arming and validation logic 28 to the follow through warhead series of switches (electrical and/or mechanical). In some embodiments, the switches (electrical and/or mechanical) are MOSFET.

The follow through warhead fuze module also includes follow through warhead fire signal logic 34. The follow through warhead fire signal logic 34 is electrically associated with the weapon computer 2 and the follow through warhead fireset and explosive train 32. The follow through warhead fire signal logic 34 is adapted to start a back-up timer when the trigger sensor 8 is triggered. A follow through warhead communication interface 38 for communication between the weapon computer 2 and the follow through warhead fire signal logic 34 is included. The weapon computer 2 is programmed to communicate to the follow through warhead fire signal logic 34 the parameters of the at least one trigger and the length of time of the back-up timer. In some embodiments, the trigger sensor 8 is triggered when the weapon has reached a pre-determined height above a predetermined object. In other embodiments, the trigger sensor 8 is triggered when the weapon experiences an impact with a pre-determined object. In some embodiments, the follow through warhead fire signal logic 34 is adapted to communicate a fire signal to the follow through warhead fireset and explosive train 32 upon each of the following occurrences until the follow through warhead explodes: 1) a pre-determined amount of delay time has passed since the trigger sensor 8 was triggered (the weapon computer 2 is also programmed to communicate to the follow through warhead fire signal logic 34 the amount of delay time); 2) the back-up timer has expired. In other embodiments, the follow through warhead fire signal logic 34 is adapted to communicate a fire signal to the follow through warhead fireset and explosive train 32 upon each of the following occurrences until the follow through warhead explodes: 1) the weapon has passed through a pre-determined number of layers since the trigger sensor 8 was triggered (the weapon computer 2 is also programmed to communicate to the follow through warhead fire signal logic 34 the number of layers that the weapon must pass through after the trigger sensor 8 was triggered before a fire signal is communicated to the follow through warhead fireset and explosive train 32); 2) the back-up timer has expired.

Method embodiments include using the weapon computer 2 located within the weapon to communicate target information to a follow through warhead fire signal logic 34 located within the weapon. The method also includes verifying, (using follow through warhead arming and validation logic 28), that a power signal provided from an electrical power supply 4 located within the weapon to the follow through warhead arming and validation logic 28 has a pre-determined amplitude and frequency. The method also includes initiating a first follow through warhead safe separation timer when the follow through warhead arming and validation logic 28 has determined that the power signal provided by the electrical power supply 4 matches a pre-determined amplitude and frequency within a pre-determined percent error. The method includes rendering safe a follow through warhead located within the weapon when the power signal provided from the electrical power supply 4 to the follow through warhead arming and validation logic 28 does not have a pre-determined amplitude and frequency.

The method also includes verifying, (using pre-cursor warhead arming and validation logic 14), that a power signal provided from the electrical power supply to the pre-cursor warhead arming and validation logic 14 has a pre-determined amplitude and frequency. The method further includes initiating a first pre-cursor warhead safe separation timer when it has been determined that the power signal provided by the electrical power supply 4 matches the pre-determined amplitude and frequency. The method further includes rendering safe a pre-cursor warhead located within the weapon when the power signal provided from the electrical power supply 4 to the follow through warhead arming and validation logic 28 does not have a pre-determined amplitude and frequency.

The method includes verifying, (using the follow through warhead arming and validation logic 28), that the weapon has experienced a transition from no differential pressure to a pre-determined pressure and initiating a second follow through warhead safe separation timer when it has been determined that the weapon has experienced a transition from no differential pressure to a pre-determined pressure.

The method includes verifying, (using the pre-cursor warhead arming and validation logic 14), that the weapon has experienced a transition from no differential pressure to a pre-determined differential pressure (and that the transition is maintained for a pre-determined amount of time) and initiating a second pre-cursor warhead safe separation timer when it has been determined that the power signal provided by the electrical power supply 4 matches the pre-determined amplitude and frequency within a pre-determined percent error.

The method includes removing a first follow through warhead energy interrupter 30 when the first follow through warhead safe separation timer has reached a pre-determined amount of time, removing a second follow through warhead energy interrupter 30 when the second follow through warhead safe separation timer has reached a pre-determined amount of time, and removing a final follow through warhead energy interrupter 30 when the follow through warhead arming and validation logic 28 has determined that the following occurred in a pre-determined order and within a pre-determined temporal window: 1) the weapon experienced a transition from no differential pressure to a pre-determined differential pressure (and the transition is maintained for a pre-determined amount of time); and 2) that the power signal provided by the electrical power supply 4 matches the pre-determined amplitude and frequency within a pre-determined percent error.

The method includes removing a first pre-cursor warhead energy interrupter 16 when the first pre-cursor warhead safe separation timer has reached a pre-determined amount of time, removing a second pre-cursor warhead energy interrupter 16 when the second pre-cursor warhead safe separation timer has reached a pre-determined amount of time, removing a final pre-cursor warhead energy interrupter 30 when the pre-cursor warhead arming and validation logic 14 has determined that the following occurred in a pre-determined order and within a pre-determined temporal window: 1) the weapon experienced a transition from no differential pressure to a pre-determined differential pressure (and the transition is maintained for a pre-determined amount of time); and 2) that the power signal provided by the electrical power supply 4 matches the pre-determined amplitude and frequency within a pre-determined percent error.

The method includes arming the follow through warhead by providing electrical power to the follow through warhead fireset and explosive train 32 when the final follow through warhead energy interrupter has been removed. The method includes rendering safe the follow through warhead by interrupting electrical power to the follow through warhead fireset and explosive train 32 when the first follow through warhead energy interrupter 30 was not electrically removed before the second follow through warhead energy interrupter 30. The method includes rendering safe the follow through warhead by interrupting electrical power to the follow through warhead fireset and explosive train 32 when the first follow through warhead energy interrupter 30 was not electrically removed within a pre-determined temporal window. The method includes rendering safe the follow through warhead by interrupting power to the follow through warhead fireset and explosive train 32 when the second follow through warhead energy interrupter 30 was not electrically removed within a pre-determined temporal window.

The method includes arming the pre-cursor warhead by providing electrical power to the pre-cursor warhead fireset and explosive train 18 when the final pre-cursor warhead energy interrupter has been removed. The method includes rendering safe the pre-cursor warhead by interrupting power to the pre-cursor warhead fireset and explosive train 18 when the first pre-cursor warhead energy interrupter 16 was not electrically removed before the second pre-cursor warhead energy interrupter 16. The method includes rendering safe the pre-cursor warhead by interrupting power to the pre-cursor warhead fireset and explosive train 18 when the first pre-cursor warhead energy interrupter 16 was not electrically removed within a pre-determined temporal window. The method includes rendering safe the pre-cursor warhead by interrupting power to the pre-cursor warhead fireset and explosive train 18 when the second pre-cursor warhead energy interrupter 16 was not electrically removed within a pre-determined temporal window.

In some embodiments, the method includes initiating a follow through warhead back-up timer when a trigger condition is sensed by a trigger sensor 8 located on the weapon and communicating a fire signal to the follow through warhead fireset and explosive train 32 when the follow through warhead back-up timer is expired.

In some embodiments, the method includes communicating a fire signal to the follow through warhead fireset and explosive train 32 when the weapon has passed through a pre-determined number of layers after the trigger condition is sensed. In other embodiments, the method includes communicating a fire signal to the follow through warhead fireset and explosive train 32 a pre-determined amount of time after the trigger condition is sensed by the trigger sensor 8. In some embodiments, the pre-determined amount of time is shorter than the amount of time it takes for the follow through warhead back-up timer to expire.

In some embodiments, the method includes initiating a pre-cursor warhead back-up timer when a trigger condition is sensed by a trigger sensor 8 located on the weapon and communicating a fire signal to the pre-cursor warhead fireset and explosive train 18 when the pre-cursor warhead back-up timer is expired.

In some embodiments, the method includes communicating a fire signal to the pre-cursor warhead fireset and explosive train 18 a pre-determined amount of time after the trigger condition is sensed by the trigger sensor 8. In some embodiments, the pre-determined amount of time is short than the amount of time it takes for the pre-cursor warhead back-up timer to expire.

Some method embodiments include: initiating a follow through warhead back-up timer when a trigger condition is sensed by a trigger sensor 8 located on the weapon and communicating a fire signal to the follow through warhead fireset and explosive train 32 when the follow through warhead back-up timer is expired; communicating a fire signal to the follow through warhead fireset and explosive train 32 when the weapon has passed through a pre-determined number of layers after the trigger condition is sensed; initiating a pre-cursor warhead back-up timer when a trigger condition is sensed by a trigger sensor 8 located on the weapon and communicating a fire signal to the pre-cursor warhead fireset and explosive train 18 when the pre-cursor warhead back-up timer is expired; communicating a fire signal to the pre-cursor warhead fireset and explosive train 18 a pre-determined amount of time after the trigger condition is sensed by the trigger sensor 8, wherein the pre-determined amount of time is shorter than the amount of time it takes for the pre-cursor warhead back-up timer to expire.

Some method embodiments include: initiating a follow through warhead back-up timer when a trigger condition is sensed by a trigger sensor 8 located on the weapon and communicating a fire signal to the follow through warhead fireset and explosive train 32 when the follow through warhead back-up timer is expired; communicating a fire signal to the follow through warhead fireset and explosive train 32 a pre-determined amount of time after the trigger condition is sensed by the trigger sensor 8, wherein the pre-determined amount of time is shorter than the amount of time it takes for the follow through warhead back-up timer to expire; initiating a pre-cursor warhead back-up timer when a trigger condition is sensed by a trigger sensor 8 located on the weapon and communicating a fire signal to the pre-cursor warhead fireset and explosive train 18 when the pre-cursor warhead back-up timer is expired; communicating a fire signal to the pre-cursor warhead fireset and explosive train 18 a pre-determined amount of time after the trigger condition is sensed by the trigger sensor 8, wherein the pre-determined amount of time is shorter than the amount of time it takes for the pre-cursor warhead back-up timer to expire.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

What is claimed is:

1. A method of fuzing a precursor warhead and a follow-through warhead in a weapon, said method comprising:

determining, using follow through warhead arming and validation logic, that a power signal provided from an electrical power supply located within said weapon to said follow through warhead arming and validation logic has a pre-determined amplitude and frequency;

initiating a first follow through warhead timer when it has been determined that said power signal provided by said electrical power supply matches said pre-determined amplitude and frequency;

determining, using pre-cursor warhead arming and validation logic, that a power signal provided from said electrical power supply to said pre-cursor warhead arming and validation logic has said pre-determined amplitude and frequency;

initiating a first pre-cursor warhead timer when it has been determined that said power signal provided by said electrical power supply matches said pre-determined amplitude and frequency;

determining, using said follow through warhead arming and validation logic, that said weapon has experienced a transition from no differential pressure to a pre-determined differential pressure;

initiating a second follow through warhead timer when it has been determined that said weapon has experienced said transition from no differential pressure to said pre-determined differential pressure;

determining, using said pre-cursor warhead arming and validation logic, that said weapon has experienced said transition from no differential pressure to said pre-determined differential pressure;

initiating a second pre-cursor warhead timer when it has been determined that said weapon has experienced said transition from no differential pressure to said pre-determined differential pressure;

rendering safe said follow through warhead by prohibiting conduction of power from said follow through warhead arming and validation logic to a follow through warhead fireset and explosive train by prohibiting conduction across a first plurality of electrical switches until;

said first follow through warhead timer has reached a first pre-determined amount of time;

said second follow through warhead timer has reached a second pre-determined amount of time; and said follow through warhead arming and validation logic has determined that the following occurred in a pre-determined order and within a pre-determined temporal window: 1) the weapon experienced said transition from no differential pressure to said pre-determined differential pressure; and 2) said power signal provided by the electrical power supply to said follow through warhead arming and validation logic matches said pre-determined amplitude and frequency within a pre-determined percent error;

rendering safe said pre-cursor warhead by prohibiting conduction of power from said pre-cursor warhead arming and validation logic to a pre-cursor warhead fireset and explosive train by prohibiting conduction across a second plurality of electrical switches until;

said first pre-cursor warhead timer has reached said first pre-determined amount of time;

said second pre-cursor warhead timer has reached said second pre-determined amount of time; and said pre-cursor warhead arming and validation logic has determined that the following occurred in said pre-determined order and within said predetermined temporal window: 1) the weapon experienced said transition from no differential pressure to said pre-determined differential pressure; and 2) said power signal provided by said electrical power supply to said pre-cursor warhead arming and validation logic matches said pre-determined amplitude and frequency within said pre-determined percent error;

arming said follow through warhead by providing power to said follow through warhead fireset and explosive train by allowing conduction across said first plurality of electrical switches when:

said first follow through warhead timer has reached said first pre-determined amount of time;

said second follow through warhead timer has reached said second pre-determined amount of time; and said follow through warhead arming and validation logic has determined that the following occurred in said pre-determined order and within said pre-determined temporal window: 1) said weapon experienced said transition from no differential pressure to said pre-determined differential pressure; and 2) that said power signal provided by said electrical power supply to said follow-through warhead arming and validation logic matches said pre-determined amplitude and frequency within said pre-determined percent error;

arming said pre-cursor warhead by providing power to said follow through warhead fireset and explosive train by allowing conduction across said second plurality of electrical switches when:

said first pre-cursor warhead timer has reached said first pre-determined amount of time;

said second pre-cursor warhead timer has reached said second pre-determined amount of time; and said pre-cursor warhead arming and validation logic has determined that the following occurred in said pre-determined order and within said pre-determined temporal window: 1) the weapon experienced said transition from no differential pressure to said pre-determined differential pressure; and 2) said power signal provided by the electrical power supply to said pre-cursor warhead arming and validation logic matches said pre-determined amplitude and frequency within said pre-determined percent error;

initiating a third pre-cursor warhead timer when a trigger condition is sensed by a trigger sensor on said weapon, wherein said trigger sensor is selected from the group of trigger sensors consisting of accelerometers, g-switches, and crush switches;

communicating a pre-cursor warhead fire signal to said pre-cursor warhead fireset and explosive train upon a first of: said trigger condition is sensed by said trigger sensor; and said third pre-cursor warhead timer is expired;

initiating a third follow through warhead timer when said trigger condition is sensed by said trigger sensor; and communicating a follow-through warhead fire signal to said follow through warhead fireset and explosive train upon a first of: said third follow through warhead timer is expired; and said weapon has passed through a pre-determined number of layers after said trigger condition is sensed.

2. The method of claim 1, wherein each of said first plurality of electrical switches is a Metal-Oxide Semiconductor Field Effect Transistor.

3. The method of claim 1, wherein each of said second plurality of electrical switches is a Metal-Oxide Semiconductor Field Effect Transistor.

4. The method of claim 2, wherein each of said second plurality of electrical switches is a Metal-Oxide Semiconductor Field Effect Transistor.

* * * * *